United States Patent [19]

Allen

[11] 3,959,945

[45] June 1, 1976

[54] ROOF TRUSS SPACER

[76] Inventor: David Allen, 1121 E. Fifth St., Berwick, Pa. 18603

[22] Filed: May 9, 1975

[21] Appl. No.: 576,216

[52] U.S. Cl. ..... 52/690; 52/127; 52/643; 52/696; 52/745

[51] Int. Cl.[2] ..... E04C 3/11

[58] Field of Search ..... 52/696, 690, 641, 643, 52/127

[56] References Cited

UNITED STATES PATENTS

| | | | |
|---|---|---|---|
| 1,532,695 | 4/1925 | Harting et al. | 52/643 X |
| 2,042,370 | 5/1936 | Walker | 52/696 |
| 2,642,825 | 6/1953 | McElhone et al. | 52/641 |
| 2,695,083 | 11/1954 | De Wolf | 52/696 |
| 3,091,002 | 5/1963 | Nicholson | 52/641 |
| 3,172,507 | 3/1965 | Blyveis | 52/643 |

*Primary Examiner*—Alfred C. Perham

[57] ABSTRACT

Method and apparatus for spacing prefabricated trusses and other structural members during erection thereof, which method and apparatus provides for the spacing of the members at a preselected distance from similar adjacent members or the like.

2 Claims, 7 Drawing Figures

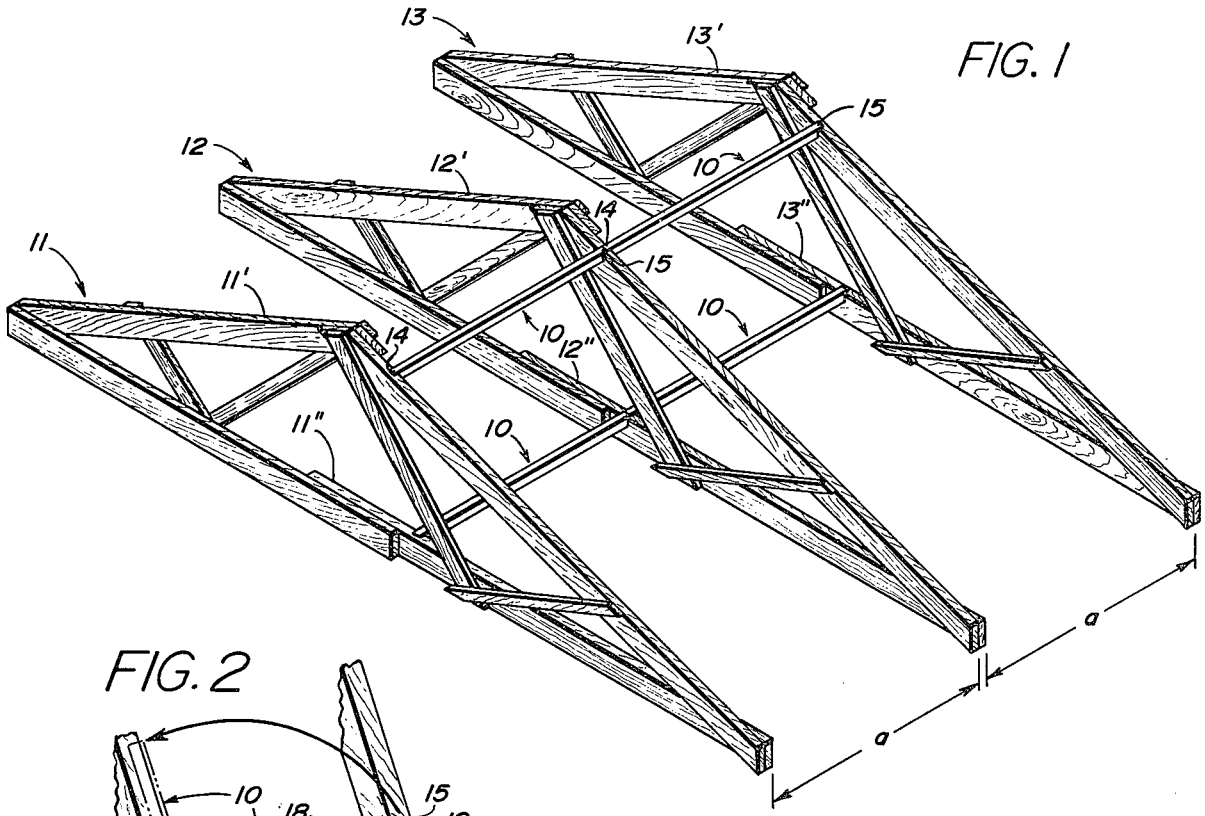
FIG. 1
FIG. 2
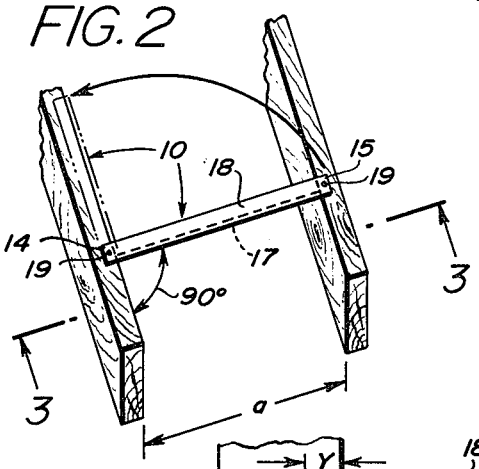
FIG. 3
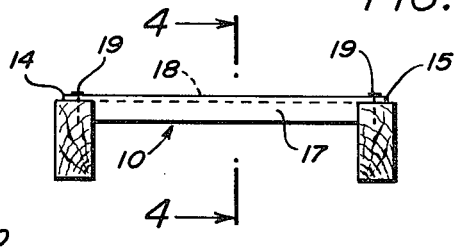
FIG. 7
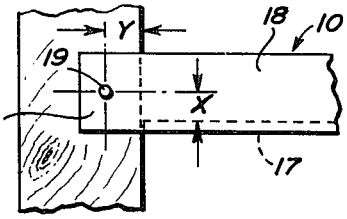
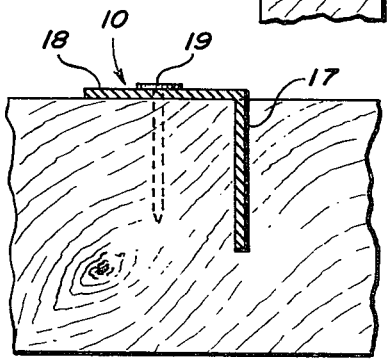
FIG. 4
FIG. 5
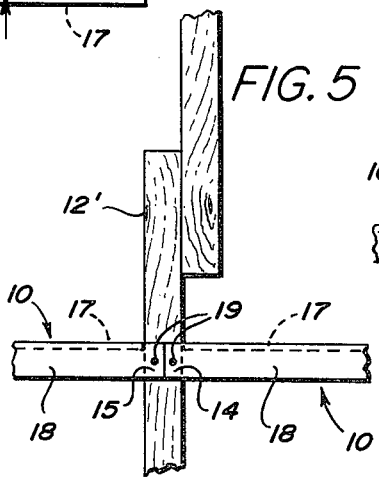
FIG. 6
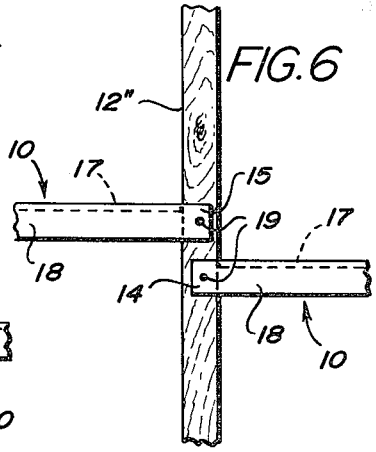

ROOF TRUSS SPACER

BACKGROUND OF THE INVENTION

In the construction of building structures prefabricated members, i.e., roof trusses and roof rafters, are used to support the roof decking. The distance between roof trusses and/or rafters is generally determined by measuring with a ruler and nailing wooden strips, 1 × 2 in. in cross section, to secure the members in place. Mistakes in measuring are common and time is lost in correcting the mistakes. Furthermore, after the trusses or rafters are fixed in the desired location the strips must be removed to permit the roof sheeting to be installed. The strips are frequently thrown away as scrap, resulting in the waste of expensive lumber.

SUMMARY OF THE INVENTION

It is an object of the instant invention to provide a method and apparatus to efficiently and economically erect prefabricated members such as roof trusses and roof rafters.

It is a further object of the instant invention to provide spacer apparatus for spacing structural members wherein the spacers will remain permanently attached to the member.

A still further object of the instant invention is to provide spacing apparatus which will remain attached to the assembled structural members as a bracing member to stabilize the structure during construction and thereafter.

These objects are accomplished by the method and apparatus of the instant invention which includes a spacer member pivotally attached to a first structural member and adapted to be rotated 90° to engage a similar structural member or the like adjacent thereto to which the spacer is affixed.

BRIEF DESCRIPTION OF THE DRAWINGS

FIG. 1 is an isometric view of a plurality of spaced wooden roof trusses using the spacer of this invention;

FIG. 2 is an isometric view of the spacer applied to floor joists;

FIG. 3 is a view taken on the line 3—3 of FIG. 2;

FIG. 4 is a view taken on line 4—4 of FIG. 3;

FIG. 5 is a view showing a preferred arrangement for attachment of the spacer;

FIG. 6 is a view showing an alternate arrangement for attachment of the spacer; and FIG. 7 is a detail of the pivotally attached end of the spacer.

DESCRIPTION OF THE PREFERRED EMBODIMENT

Referring now to the Figures and more particularly to FIG. 1, the spacers 10 of the instant invention which comprise an elongated L-shaped member having connecting means at either end thereof, are seen applied to the erection of prefabricated structural frames, as e.g. wood trusses 11, 12 and 13 at the top chords 11′, 12′ and 13′ and the bottom chords 11″, 12″ and 13″. The isometric view of a plurality of trusses of FIG. 1 indicates a distance *a* which has been determined by the builder as the desirable spacing for the trusses of the structure being erected. The trusses 11, 12 and 13 are fabricated at a first or assembly site which is remote from a second or erection site. The trusses are transported by well-known means to the second site. At the second site, the first or end prefabricated structural frame, truss 11, is erected on a structure and secured in place by conventional means. The second or adjacent prefabricated structural frame, truss 12, is raised into the approximate desired location and properly spaced from the first prefabricated structural frame, truss 11, by the method and apparatus of this invention. Each prefabricated structural frame or truss is provided during fabrication at the first site with at least one spacer 10 mounted on the bottom and/or top chords of each of the prefabricated structural frames or trusses. The ends or tabs 14 of spacers 10 are pivotally attached by pin-like holding members such as nails, bolts or screws to the top surfaces of the top chords 11′, 12′ and 13′ and the bottom chords 11″, 12″ and 13″ respectively. The free ends or tabs 15 of the spacers 10 may be temporarily held against the chord members during transportation thereof by any means, as e.g. by friction between the chord member and the spacer 10 caused by said holding means. The spacer 10 on the adjacent prefabricated structural frame or truss must be rotated before erection so as to be in a position to abut the spacer 10 of the first prefabricated structural frame or truss as shown in the arrangement of FIG. 5. An alternate method is shown in FIG. 6 wherein the spacer 10 of one prefabricated structural frame or truss is offset from the spacer 10 of the adjacent prefabricated structural frame or truss. This latter arrangement requires that attention be given at the assembly site and at the erection site to the alternating arrangement of spacers 10.

As seen in FIGS. 3 and 4 the spacer 10 comprises an L-shaped elongated member of metal, preferably 30 gage sheet metal, having a downwardly extending leg 17 which is shorter than the top surface 18 of the spacer 10. The longer top surface 18 includes tabs 14 on one end and 15 on the other end which extend the upper surface 18 and may be provided with holes 19 located as hereinafter described. The shorter downwardly extending leg 17 has a length equal to the distance *a* which provides the correct spacing for the prefabricated structural frames, as e.g. truss members 11, 12 and 13. It is understood that hole 19 may be provided only at the end of the spacer that is attached to the prefabricated structural frame or truss member at the factory. The other end of the light gauge spacer material is easily pierced by nailing means.

As hereinbefore noted, tab 14 of spacer 10 is pivotally attached to a chord member of the prefabricated structural frame, truss member 11, 12 or 13 before erection, at a site remote from the construction site, and when erected frame or truss member and the spacer is rotated 90°. Upon such rotation the end of leg 17 adjacent end 14 contacts the prefabricated structural frame or truss member and spacer 10 is now extending perpendicular to the truss member. Next, the adjacent prefabricated structural frame or truss member is placed in contact with the other end of leg 17, i.e., the end adjacent tab 15 whereupon the tab 15 is fastened to the adjacent truss to properly space the trusses and provide bracing therebetween. In the embodiment shown in FIG. 5, spacer 10 on the adjacent truss member must be rotated prior to erection so that the tabs 14 and 15 abut. When sheeting is applied to the top chords of the truss members 11, 12 and 13, it is not necessary to remove the spacers 10 as was the former practice with 1 × 2 wood strips. The thickness of gage of the spacers 10 is so slight as to have no effect on nailing down of sheeting on the top chord members 11', 12' and 13'.

FIG. 2 shows an alternate embodiment of the invention in which the spacer 10 can be effectively applied to spacing other structural members such as floor joists 20 in the same manner as described hereinbefore.

FIGS. 5 and 6 referred to hereinbefore indicate alternate methods of applying spacers 10 to structural members. In FIG. 5 it is seen that two adjacent spacers 10 abut one another and this arrangement can be used in cases where the structural members are sufficiently wide to accommodate a sufficient edge distance from the hole, as e.g. ¾ inch. FIG. 6 shows a means whereby the spacers can be staggered to allow for adequate edge distance on a thinner member.

FIG. 7 is a detail of the tab 14 of spacer 10 which is attached to a prefabricated structural frame at the first or assembly site. The spacer 10 is shown in its erected position rotated 90° from its carrying position so that the spacer member 10 extends at right angles to the longitudinal axis of the prefabricated structural frame, as e.g. a truss. Means for pivotally connecting one of the tabs, tab 14, to a structural member is seen in FIG. 7 and comprises an aperture in one of the tabs, tab 14, located at a point which is positioned on tab 14 equidistant from the inside surface of downwardly extending leg 17 on an axis which is parallel thereto, distance $x$, and from the end of downwardly extending leg 17 on an axis which is perpendicular to the inside surface of leg 17, distance $y$. A pin-like member 19 adapted to secure one of the tabs, tab 14, to one of the structural members is also included in the pivotal connecting means. It is clear from FIG. 7 that distance $x$ and distance $y$ must be equal so that when the spacer 10 is rotated 90° the end of downwardly extending leg 17 will abut against the structural member 11', 12' or 13' and/or 11'', 12'' and 13''. Tabs 14 and 15 of spacer 10 extend the upper surface 18 beyond the extent of the downwardly extending leg 17 for attaching to the prefabricated structural frames.

The carrying position of spacer 10 is seen drawn in phantom in FIG. 2 and rotated 90° to the position shown in full lines.

In operation, and referring to FIG. 1, the erection of at least two adjacent structural frames 11 and 12 is accomplished by fabricating at least two structural frames 11 and 12 at a first assembly site which is remote from a second erection site. Each frame, except one, has a spacer 10 pivotally attached thereto at the assembly site. The prefabricated structural frames 11 and 12 are transported by conventional means to the second or erection site. A first structural frame 11 is secured in its proper location in a structure at the second site. Another or second structural frame 12 is placed adjacent to and spaced from the first structural frame 11 in the structure a distance $a$. The spacer 10 which is attached to one of the erected structural frames is rotated so that it extends at right angles to the longitudinal axes of the erected first and second structural frames. The free end 15 of the spacer is secured to the other structural frame. The process is repeated by placing additional structural frames on the structure and rotating and securing the spacers in the same manner until all of the desired number of structural frames are spaced a substantial equal distance apart and properly located in the structure.

It is thus clearly evident that my invention provides a method and apparatus for providing uniform spacing between prefabricated structural frames, as e.g. roof trusses. Furthermore, the spacer does not need to be removed to install the roof sheeting or decking, thus providing additional rigidity and saving the labor and material that would be needed if traditional wooden spacer strips were installed and removed.

I claim:

1. A prefabricated truss comprising a. a spacer pivotally attached to a chord of said truss and adapted to space said truss from a similar adjacent truss in a structure, b. said spacer comprises an elongated member having an upper surface and a downwardly extending leg with a length equal to the desired space between said truss and said adjacent truss, c. tabs located on either end of said upper surface which extend said upper surface beyond the extent of said downwardly extending leg, d. connecting means for pivotally securing one of said tabs to said chord whereby said elongated member may extend parallel to said chord with the inside surface of said downwardly extending leg contacting said chord and may be rotated therefrom 90° to place an end of said downwardly extending leg in contact with said chord and to position said elongated member perpendicular to said chord, and e. said connecting means comprises i. a sole aperture in said one of said tabs located with its center positioned on said tab equidistant from said inside surface of said downwardly extending leg on an axis which is parallel thereto and from said end of said downwardly extending leg on an axis which is perpendicular to said inside surface, and ii. a pin-like member passing through said aperture secured to said chord.

2. A method for erecting at least two trusses comprising the steps of:

a. fabricating at least two trusses at a first assembly site which is remote from a second erection site, each truss except one having a spacer pivotally attached thereto with said spacer consisting of an L-shaped member having an upper surface and a downwardly extending leg with a length substantially equal to the desired space between adjacent trusses and tabs located at either end of said upper surface which extend said upper surface beyond the extent of said downwardly extending leg and allow the spacer to be attached to the trusses, b. securing a first truss in its proper location in a structure at said second site, c. placing another truss adjacent to and spaced from the first truss, d. rotating the spacer attached to one of the trusses of steps (b) and (c) so that said spacer extends at right angles to the longitudinal axes of the trusses of steps (b) and (c) with the ends of said downwardly extending leg in contact with said trusses, e. attaching the free end of said spacer to the other truss, and f. repeating said placing of the remaining trusses and said rotating of the spacers and said attaching of the free ends of said spacers until all trusses are spaced a substantially equal distance apart and properly located in said structure.

* * * * *